US005285920A

United States Patent [19]

McGarvey

[11] Patent Number: 5,285,920

[45] Date of Patent: * Feb. 15, 1994

[54] FIRE RESISTANT TANK ASSEMBLY AND LIQUID HYDROCARBON DISPENSING

[75] Inventor: David C. McGarvey, San Gabriel, Calif.

[73] Assignee: LRS, Inc., South El Monte, Calif.

[ * ] Notice: The portion of the term of this patent subsequent to Feb. 5, 2008 has been disclaimed.

[21] Appl. No.: 803,612

[22] Filed: Dec. 9, 1991

Related U.S. Application Data

[63] Continuation-in-part of Ser. No. 509,142, Apr. 6, 1990, Pat. No. 5,989,750, which is a continuation-in-part of Ser. No. 331,548, Mar. 31, 1989, Pat. No. 5,012,949.

[51] Int. Cl.[5] ..... B65D 90/04

[52] U.S. Cl. ..... 220/444; 220/445; 220/453

[58] Field of Search ..... 220/1.5, 444, 445, 453, 220/466, 467

[56] References Cited

U.S. PATENT DOCUMENTS

| | | |
|---|---|---|
| 810,237 | 1/1906 | Wadsworth . |
| 1,114,019 | 10/1914 | Morris . |
| 1,273,195 | 7/1918 | Snyder . |
| 1,625,765 | 4/1927 | Ratzenstein . |
| 1,724,582 | 8/1929 | Hart . |
| 2,460,054 | 1/1949 | Wiggins . |

(List continued on next page.)

OTHER PUBLICATIONS

Uniform Fire Code, 1985 Ed., pp. 203-278.

Reliance Tank Sales Materials (undated)—price list date Jan. 20, 1989.

Agape Tank Sales materials (dated by postmark Jun. 7, 1989).

Doehrman, Inc.—facsimile dated May 9, 1989.

Safe-T-Tank Corp. sales materials dated 1987-Sales materials from Air Boy (Jun. 1988)—advertisement dated Feb. 1987 from Keesee, "Lube Cube" sales materials dated Jul. 1, 1988.

UL 142 Standard for Safety, Steel Aboveground Tanks (1987).

Husky 1030 Double Diaphragm Pump (1987) instructions and parts list.

"Oil Evacuation System", Aro Corp., (1982).

"½" Waste Oil Evacuation System (drawing dated Mar. 15, 1987).

"Aro Air Operated Diaphragm Pumps", (1986).

"Aro Lubrication Equipment" (1989), pp. 31 and 33.

Cla-Val Co. float control parts list (1977).

Brochure—"Underwriters Laboratory Listed Tank", Air Boy Sales & Manufacturing Company.

Internal Search Report PCT/US90/01654, Mar. 28, 1990.

*Primary Examiner*—J. Moy

*Attorney, Agent, or Firm*—William W. Haefliger

[57] ABSTRACT

A fire resistant tank apparatus adapted for transportation and for installation above-ground to receive and dispense a liquid hydrocarbon or hydrocarbons, or the like, comprising a tank assembly having lightweight wall structure defining inner wall structure, and in certain instances outer wall structure, there being primary space between the inner wall structure, and the outer wall structure; first structure on the assembly defining access porting to a tank interior defined by the assembly; a bottom wall defined by the assembly adapted to support the assembly at an installation site; thermal barrier material associated with the wall structure to effectively define a shell about the tank interior; and structure adjacent the wall structure to support a dispenser for the liquid hydrocarbon or hydrocarbons, or the like, that structure may include a platform unit projecting sidewardly adjacent a lower portion of the outer wall structure, for supporting the dispenser in adjacent relation to the side of the outer wall structure. A portable, metallic support plate and berm may be provided for use below the tank apparatus.

16 Claims, 10 Drawing Sheets

U.S. PATENT DOCUMENTS 2,558,694 6/1951 Speig .
2,772,834 12/1956 Swenson et al. .
2,858,136 10/1958 Rind .
2,860,807 11/1958 Morton .
2,864,527 12/1958 Altman et al. .
2,869,751 1/1959 Klope et al. .
2,931,211 4/1960 McCullough .
3,595,424 7/1971 Jackson .
3,666,132 5/1972 Yamamoto et al. .
3,702,592 11/1972 Gamble .
3,827,455 8/1974 Lee .
3,941,272 3/1976 McLaughlin .
3,952,907 4/1976 Ogden et al. .
3,967,256 6/1976 Galatis .
3,969,563 7/1976 Hollis, Sr. .
3,989,862 11/1976 Butler et al. .
4,069,075 1/1978 Billing et al. .
4,376,489 3/1983 Clemens .
4,469,129 9/1984 Dixon .
4,493,945 1/1985 Feldman .
4,651,893 3/1987 Mooney .
4,685,327 8/1987 Sharp .
4,697,618 10/1987 Youtt et al. .
4,815,621 3/1989 Bartis .
4,826,644 5/1989 Lindquist et al. .
4,844,287 7/1989 Long .
4,890,983 1/1990 Solomon et al. .
4,893,397 1/1990 Hughes .
4,989,750 2/1991 McGarvey .
5,004,632 4/1991 McGarvey et al. .
5,005,615 4/1991 McGarvey et al. .
5,012,949 5/1991 McGarvey et al. .
5,016,689 5/1991 McGarvey et al. .
5,038,456 8/1991 McGarvey .

FIG. 5.
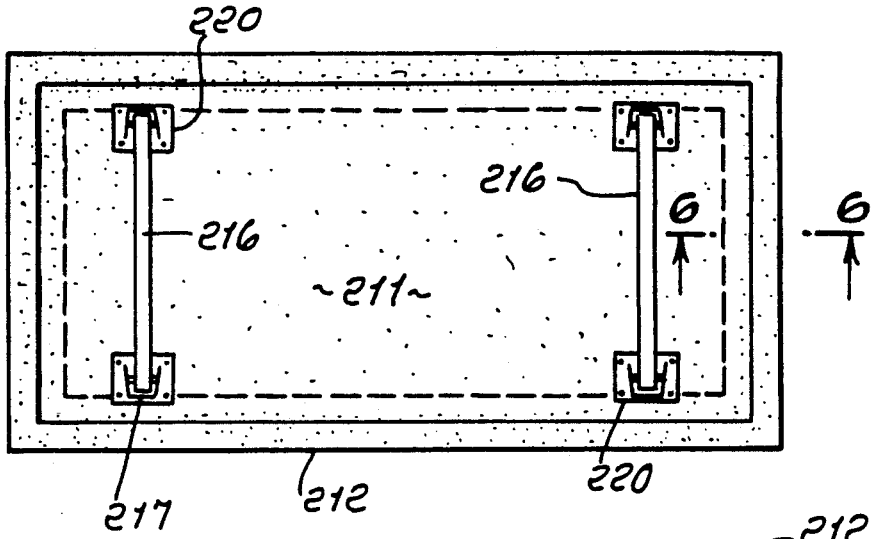
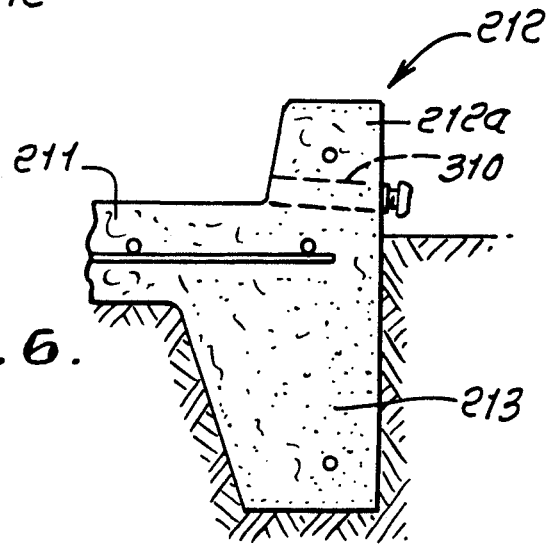
FIG. 6.
FIG. 7.
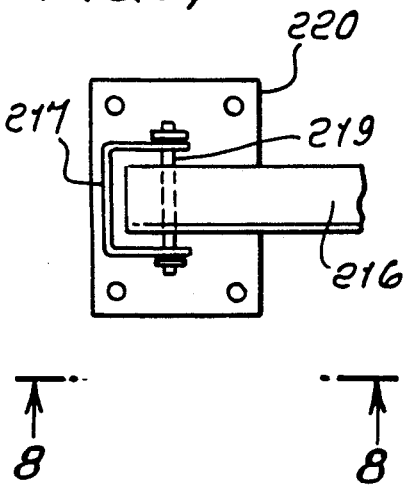
FIG. 8.
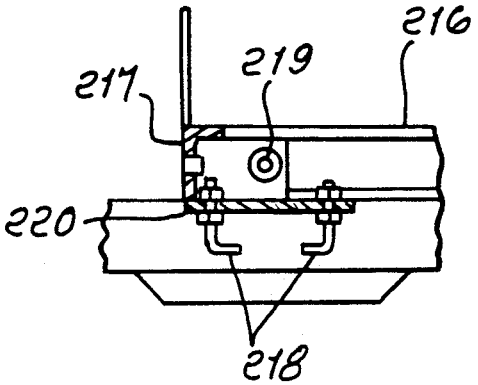

FIRE RESISTANT TANK ASSEMBLY AND LIQUID HYDROCARBON DISPENSING

This application is a continuation-in-part of Ser. No. 509,142 filed Apr. 16, 1990, now U.S. Pat. No. 5,989,750 which is a continuation-in-part of Ser. No. 331,548 filed Mar. 31, 1989 now U.S. Pat. No. 5,012,949.

BACKGROUND OF THE INVENTION

This invention relates generally to tanks for flammable and combustible liquids, and more particularly concerns methods and means for making such tanks fire resistant in above-ground installation environments.

Tanks holding flammable or combustible liquids, such as new and used hydrocarbon products, if installed above ground, can be dangerous if not "fireproofed", i.e., made "fire resistant". For example, if the tanks leak flammable liquid, a fire danger will exist. Fire can weaken the lightweight tank walls and lead to tank collapse and spillage of tank contents. Also, prior tanks were not, in general, bullet resistant.

In the past, such tanks were enclosed in concrete and transported to installation sites; however, the concrete is subject to cracking, which then can allow leakage to the exterior of flammable liquid leaking from the tank itself. Also, the concrete-enclosed tank is extremely heavy and difficult to transport. There is need for method and means to make such tanks fireproof and leak proof in such a way that a relatively lightweight unit is provided, for ease of transportation and installation, and subsequent safety. Also, there is need for ease of safety dispensing liquid hydrocarbons from above-ground tanks.

SUMMARY OF THE INVENTION

It is a major object of the invention to provide means meeting the above need. Basically, the apparatus of the invention is embodied in a metallic tank assembly that is fire resistant and defines an effective, efficient thermal barrier, the tank assembly adapted for transportation and for installation above-ground to receive and dispense a liquid hydrocarbon or hydrocarbons, or the like.

It is another object to provide fire resistant tank apparatus that includes:

a) a tank assembly having lightweight wall means defining inner walls means, and outer wall means, there being primary space between the inner wall means, and the outer wall means, b) first means on the assembly defining access porting to a tank interior defined by the assembly, c) a bottom wall defined by the assembly adapted to support the assembly at an installation site, d) thermal barrier material located in the primary space to effectively define a shell about the tank interior, e) and structure adjacent the wall means to support a dispenser for the liquid hydrocarbon or hydrocarbons, or the like.

As will be seen, the thermal barrier material may substantially fill the primary space, i.e., the space between the inner and outer metallic wall means; and the thermal barrier may enclose the inner wall means at the top, bottom and sides thereof.

It is a further object to provide a tank assembly as referred to wherein the inner wall means defines an inner tank forming the tank interior, and the outer wall means defines an outer tank extending about the inner tank. As will be seen, the outer wall means may in certain instances be omitted.

Yet another object is the provision of support and thermal barrier material which includes:

i) support structure beneath and transmitting weight applied by the inner tank, ii) filled in barrier material extending about the support structure in the primary space.

Also, fire resistant material may be applied as a coating to the inner tank surface, the thermal barrier material located between that coating and the outer tank. Access porting may be provided at the top of the tank assembly to enable access to the inner tank.

Another object is to provide a support unit projecting sidewardly adjacent the wall means to support a dispenser for the liquid hydrocarbon or hydrocarbons, or the like, the structure including a platform unit projecting sidewardly adjacent a lower portion of the outer wall means, for supporting the dispenser in adjacent relation to the side of the outer wall means. A drain is typically provided to drain leaking liquid hydrocarbon to a receptacle below the level of the structure; and the receptacle may extend beneath the entire tank structure and have a bounding berm or dike, as will appear. Accordingly, ease of fuel dispensing, with safety, are provided.

Yet another object is to provide a metallic plate structure beneath the tank assembly and supporting the assembly, and a berm extending in a loop, on the plate structure to retain liquid draining from the assembly on the plate structure. The berm may be hollow to provide utility space, and crash poles may be provided about the berm.

These and other objects and advantages of the invention, as well as the details of an illustrative embodiment, will be more fully understood from the following specification and drawings, in which:

DRAWING DESCRIPTION

FIG. 1 is a side elevational view of a metallic, multi-wall tank assembly with accessible tank and dispenser means and drain system;

FIG. 1*a* is a vertical section showing equipment used with the tank assembly;

FIG. 2 is a vertical section taken on lines 2—2 of FIG. 1;

FIG. 2*a* shows a modified tank assembly similar to FIG. 1*a;*

FIG. 5 is a top plan view of a receptacle unit for supporting the multi-wall tank assembly of FIG. 1;

FIG. 6 is an enlarged section taken on lines 6—6 of FIG. 5;

FIG. 7 is an enlarged plan view of a tank support assembly;

FIG. 8 is an elevation taken on lines 8—8 of FIG. 7;

DETAILED DESCRIPTION

Figure 1:
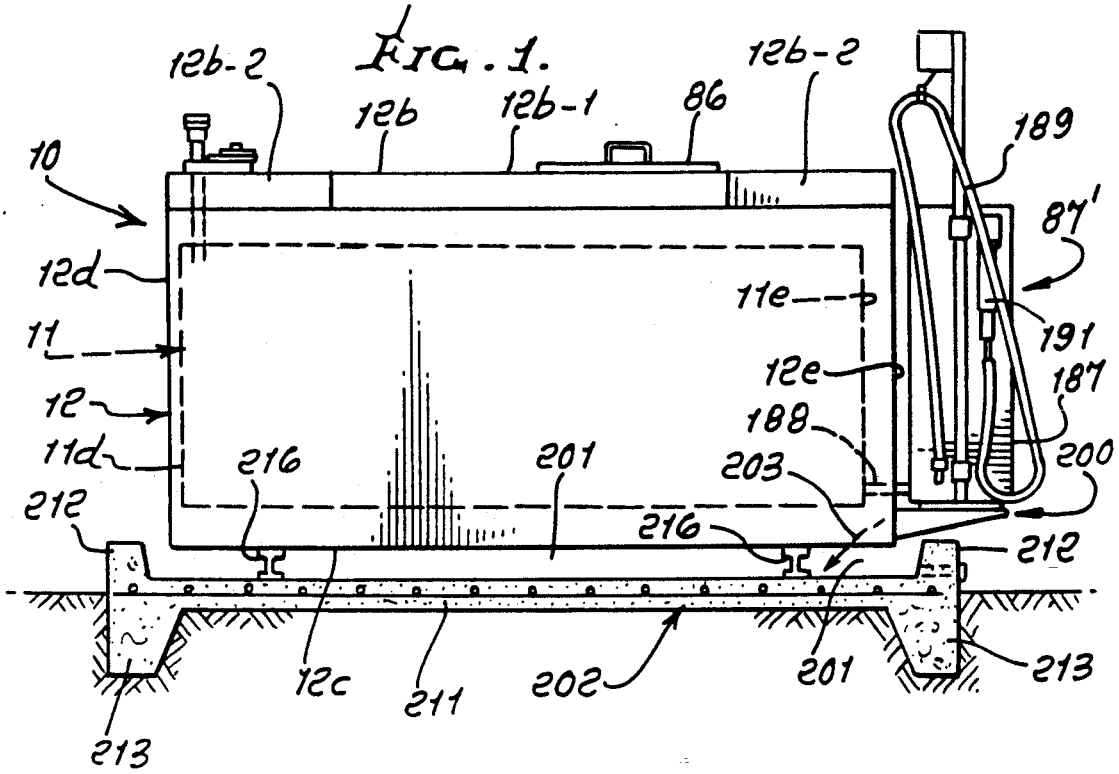
Figure 2:
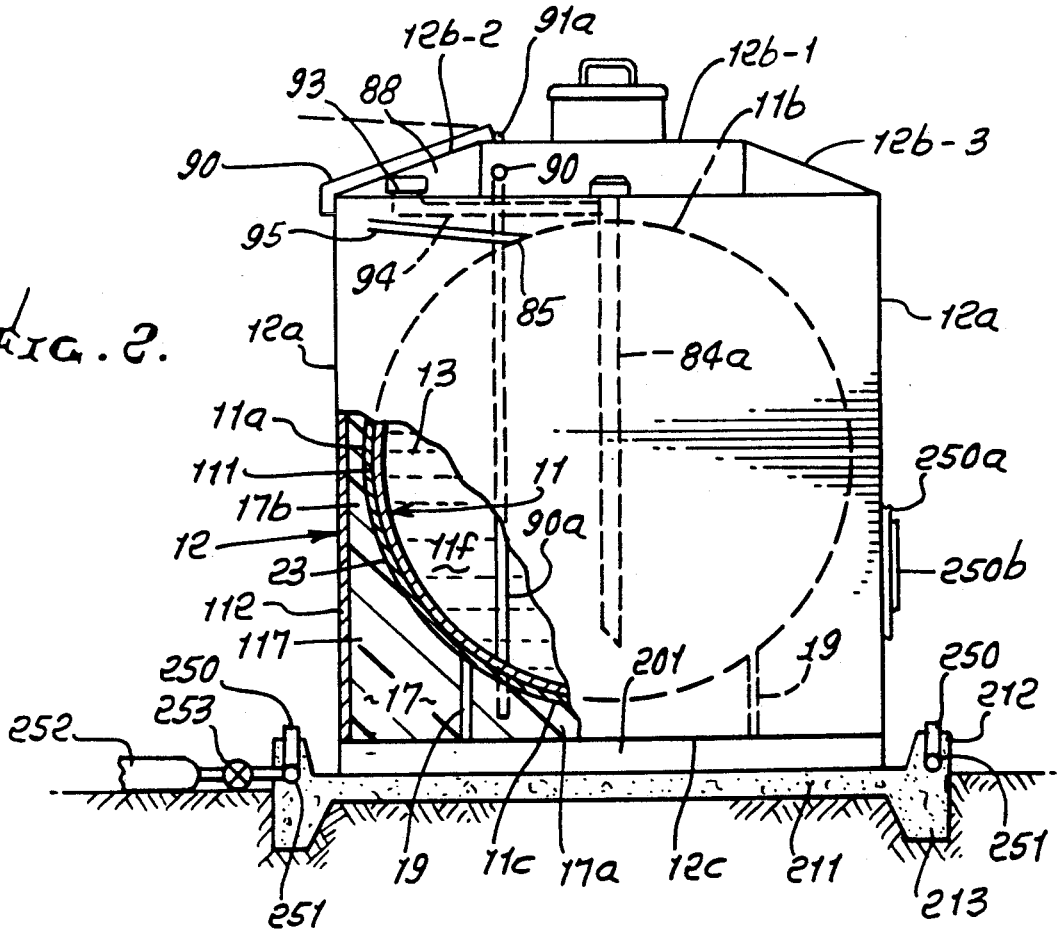

FIGS. 1 and 2 show a tank assembly 10 having lightweight wall means defining inner wall means 11, and outer wall means 12. The inner wall means 11 typically forms an inner cylindrical tank 111 having a cylindrical side wall 11*a*, top wall 11*b*, bottom wall 11*c*, and upright end walls 11*d* and 11*e*. Inner tank interior is formed at 11*f* for containing liquid hydrocarbon indicated at 13, or hydrocarbons, or the like. Vehicle fuel, such as gasoline or diesel fuel, are examples.

The outer wall means 12 typically forms an outer tank 112 having side walls 12*a*, top wall 12*b*, bottom wall 12*c*, and end walls 12*d* and 12*e* whereby the primary enclosed space 17 is formed between the two tanks, and surrounds the inner tank.

The walls of the two tanks may consist of steel and be less than one inch thick, for lightweight tank construction enhancing portability, for installation above ground at different sites, as desired. Glass fiber walls, or reinforced walls, resin impregnated, are also contemplated. Typically, steel walls are used and are about 10 gauge (⅛ to ¼ inch thick) The tank length may typically be from 4 to 50 feet. The overall tank wall thickness may be about two inches to be bullet (large caliber) resistant.

The weight of the inner tank 1 and its liquid contents are transmitted to the outer tank bottom wall 12*c*, as via steel or other fireproof struts 19 in space 17*a* between bottom walls 11*c* and 12*c*. After positioning of the tanks as shown, thermal barrier material 117 is injected, as via a nozzle, or otherwise applied into spaces 17*a*, 17*b* and above 17*b*; and if such material is expansible, it may expand therein as foam, filling such space 17 or spaces. Usable thermal barrier materials include foamed concrete, VERMICULITE, styrofoam, urethane foam, pumice, FENDOLITE, and the like. Preferably, an additional thermal barrier, such as fire resistant material in a thin (less than ¼ inch) layer 23, is applied to the outer surface of the inner tank 11. One such material is known as FENDOLITE, consisting of a mixture of VERMICULITE and Portland cement. VERMICULITE is hydrate aluminum-iron magnesium silicate; it is incombustible, and is lightweight. Portland cement is of well-known composition.

The top wall 12*b* of the outer tank includes a horizontal sub-wall 12*b*-1, and two opposite downwardly and sidewardly tapering sub-walls 12*b*-2 and 12*b*-3.

Equipment located at the top of the tank assembly is as shown, and includes

- primary (inner) tank emergency vent port 80 accessing inner space 11*f*,
- primary (inner) tank work vent port 80*a* accessing inner space 11*f*,
- secondary (outer) tank emergency vent port 80, accessing space 17,
- auxiliary ports 82 accessing inner space 11*f*, with protective (brick) plate attached to 11*c* protecting 11*c* from damage by rods or sticks inserted via 82,
- vapor recovery port 83, accessing 11*f*, fluid product fill port 84 and duct 84*a* extending into the lower interior of space 11*f*, duct 84*a* being stabilized from excessive movement by support 84*a*' attached to 11*c*,
- fluid product spill drain duct 85 accessing space 11*f*,
- fluid spill container 86 associated with 85 for containing fluid lost during product filling into tank 11, the fluid contained in space 88,
- fluid monitoring port 90 accessing space 11*f*,
- leak monitor port 87 via which fluid leaking into open (unfilled) space 17 may be monitored, i.e., detected, as by an electronic sensor, or manula gauging,
- product extraction port 81 accessing the lower interior of the inner tank space 11*f* through inlet opening 81*a*' of upright product extraction duct 81*a*. The latter is stabilized against excessive motion by support 81*a*",
- a liquid product delivery line 81*b* may be installed in space 17 to provide fire protection and leak containment. Fittings 81*b*" in space 17 stabilize 81*b* against movement.

Space 32 may contain, or be filled, with a non-oxidizable inert gas, such as $N_2$, for enhanced protection in case of leakage of hydrocarbon into the space. The assembly, as described, provides protection for the hydrocarbon contents such that up to 2,000° F. flame applied for a considerable period of time (1 to 2 hours) to the outer tank will not result in heating of the hydrocarbon contents in space 31 dangerously above ambient temperature (for example about 10% of above ambient in certain cases.

Figure 1A:
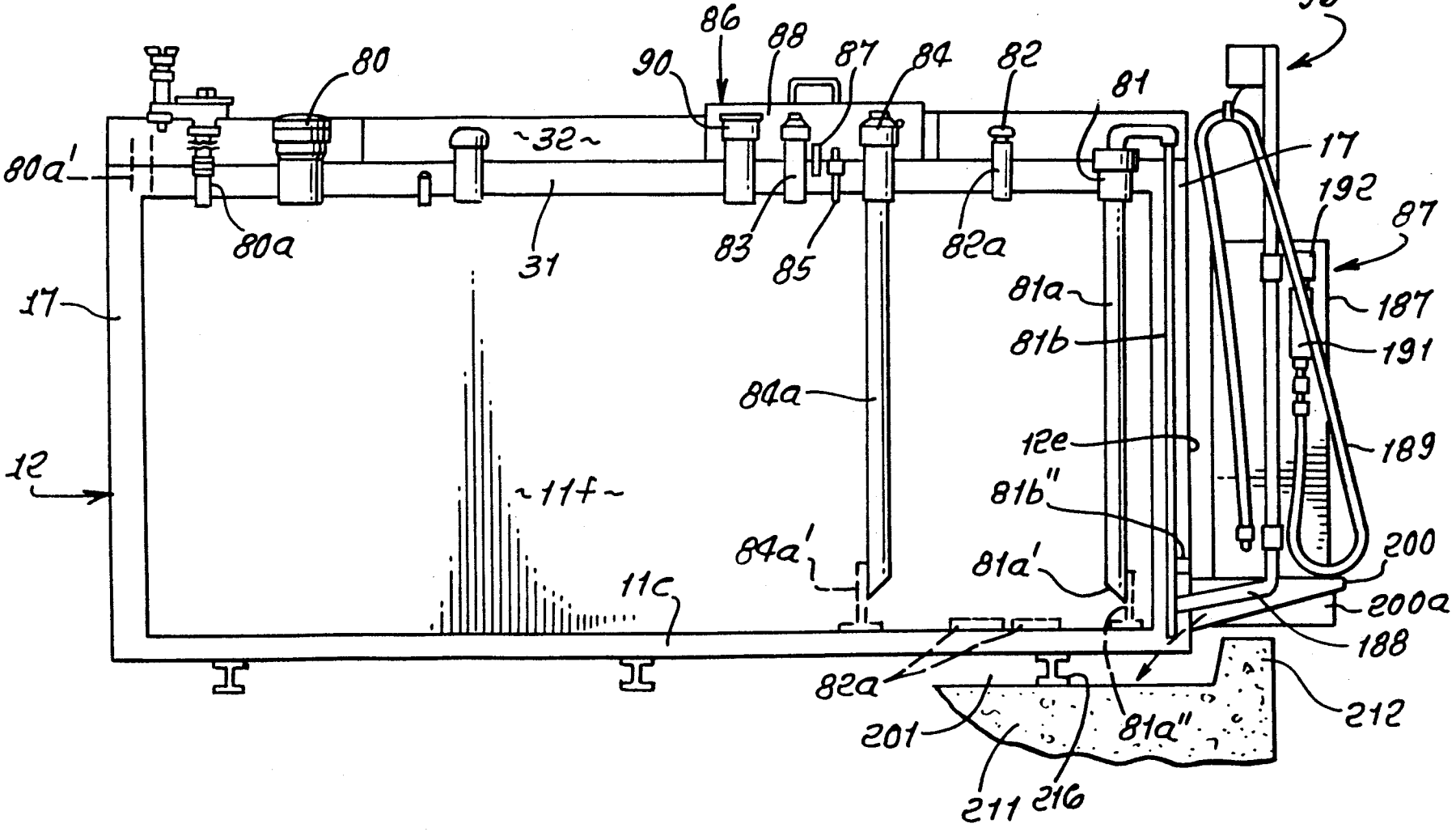

FIGS. 1, 1*a* and 2 show the provision of a 18 product delivery duct 84 having an entrance at 84*a*' accessing fuel in the lower interior of space 11*f* within the inner tank, facilitating delivery of fuel into the tank, after lifting of an access door 91 at wall 12*b*-2. See door hinge 91*a*. A monitoring port 87, upon recovery port 83, and overfill container fluid drain back port 85, are also thus accessible. See line 90*a* connecting port 90 with the lower interior space 17*a* below the inner tank. Fuel may also be filled into the tank 11 via auxiliary fill duct 93 in space 88 below the lifted door 90, connecting to fill duct 84*a*, capped at 84. Spillage resulting from such filling is conducted via the inclined wall 95 at the bottom of space 88 to the tank interior 11*f*, as via a suitable port at 85.

FIG. 1, 1*a*, 3 and 4 show the provision of a product dispenser 87, including vertically elongated pump unit 187, intake duct 188 from tank 11 via lines 81*a* and 81*b* to unit 187, and dispenser hose 189 with nozzle 191. The latter may be vertically releasably supported by unit 187, at 192, as shown. Hose 189 is retracted by retracting assembly 96, to protect the hose from damage. Structure is provided adjacent the end wall 12*e* to support the dispenser 87. See for example the platform unit 200 projecting sidewardly adjacent a lower portion of wall 12e for supporting the dispenser unit adjacent to the end of tank 12 at wall 12e, enabling ease of fuel dispensing; in addition any spillage from the unit 187 drains into drain or platform unit 200a of structure 200, and then downwardly and laterally to fall into collection space 201 in receptacle 202. See drainage arrows 203, as in FIGS. 3 and 4.

Figure 2A:
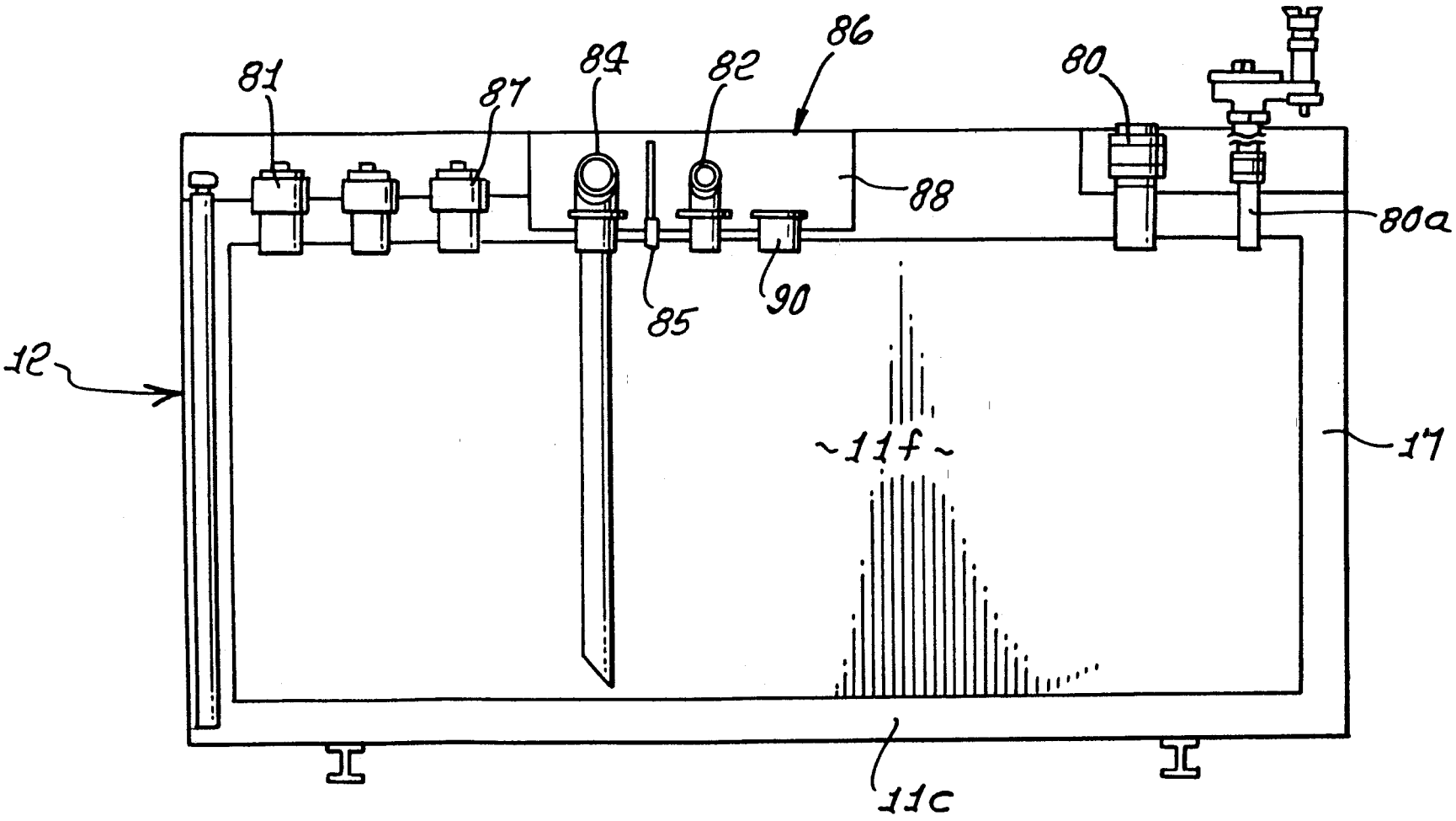

FIG. 2a shows a tank assembly somewhat similar to FIG. 1a, and with corresponding elements bearing the same numbers.

Figure 3:
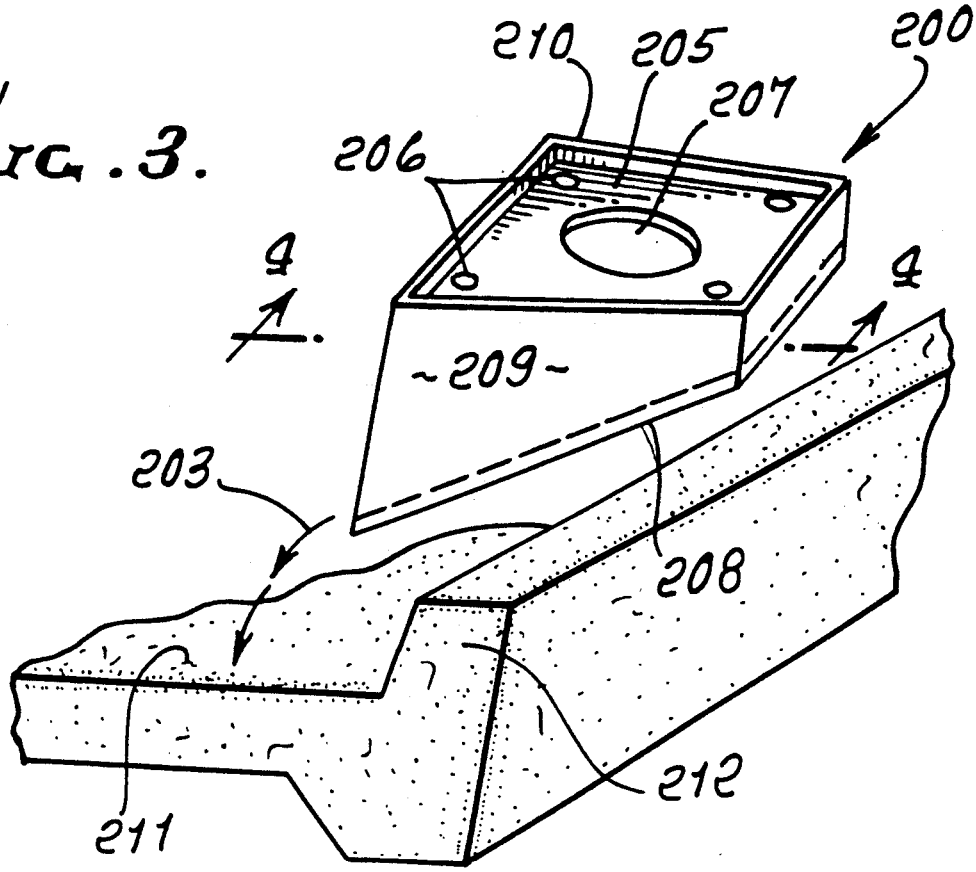
FIG. 3 is a perspective view showing a dispenser support and drain means.
Figure 4:
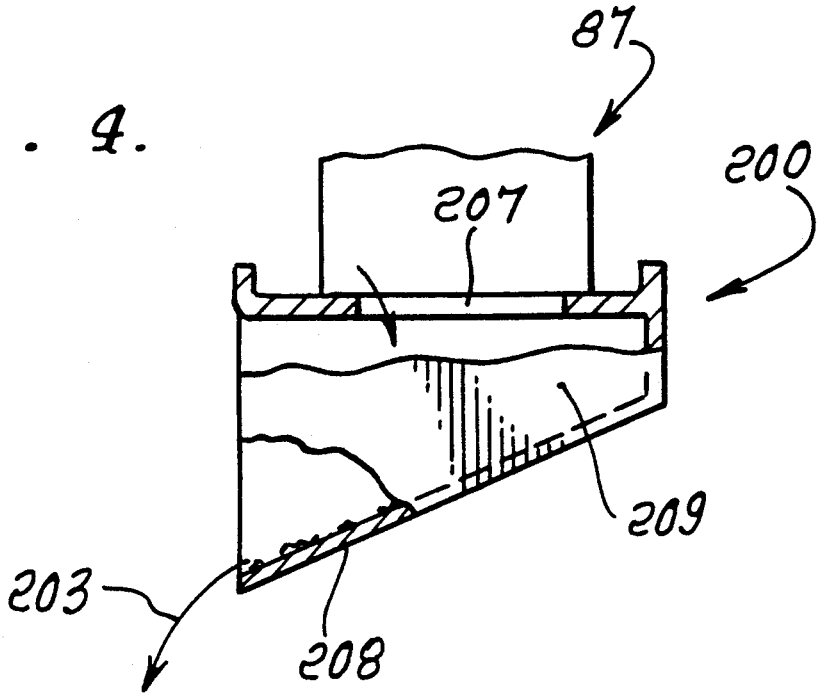
FIG. 4 is a section taken on lines 4—4 of FIG. 3.

FIGS. 3 and 4 show the platform unit 200 as including a top plate 205 to anchor the dispenser unit (see bolt holes 206), and also to drain fuel spillage as via a central opening 207. Draining fuel falls onto lower inclined plate 208, and then drains at 203. See also side plates 209 interconnecting plates 205 and 208. Liquid containing ledge 210 bounds the plate 205.

Receptacle 202 includes a concrete slab 211 having a rectangular concrete dike or berm 212 bounding the collection space 201, extending under the entirety of the tank assembly 10. Anchor legs 213 integral with slab 211 project into the earth and act as supports. I-beams 216 support the tank assembly 10 on the upper surface of the slab, as shown. Fire extinguishing material (such as water or $CO_2$) may be released from nozzle 250 spaced along the berm and supplied via manifold 251 in the berm, storage bottle 252 and emergency valve 253.

FIGS. 5 to 8 show anchor structure to anchor the beams 216 to the slab. See shackle 217 bolted at 218 to the slab, and to which the beam is bolted at 219. See drain 310 in berm wall 212a. Anchor plates ar provided at 220. Seismic stability is thereby achieved.

Fire-resistant material may, if desired, be sprayed via a nozzle onto the outermost tank walls to form a first layer 250a which is allowed to harden or cure in situ, covering all such walls. Then, if desired, a second nozzle, or the same nozzle, may be employed to spray the material onto layer 250a, forming a second layer 250b, also allowed to harden in situ, covering all outer walls or layers 250a. The combination of thus formed fire resistant sub-shells form a composite shell, leak resistant, fire resistant, and projectile resistant, typically having a thickness between ¼ inch and 1 inch, and which chars when heated to elevated temperatures (1,000° F. to 2,000° F.) as by intense flames.

A wire mesh may be applied between such layers or shells 250a and 250b for strengthening purposes. The application of fire-resistant material is preferably such as to coat the top wall 12b at the top of the assembly, and the supports 216 under the outer tank bottom wall 12c, as shown. Such materials are disclosed in Ser. Nos. 331,548 and 509,142 referred to above, and incorporated herein by reference.

Figure 9:
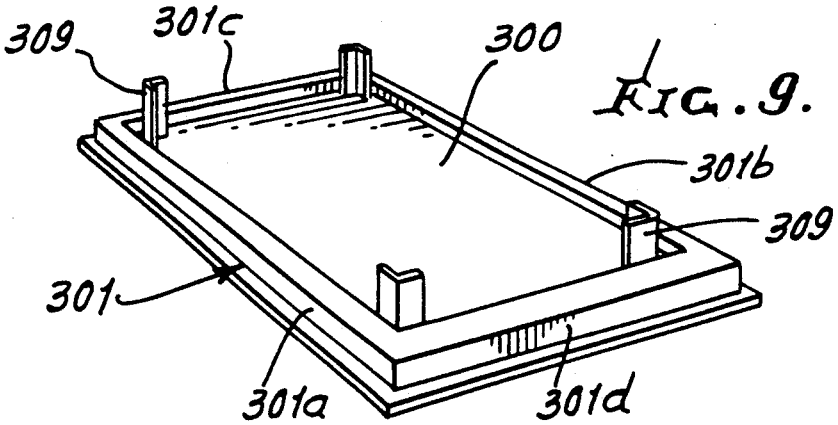
FIG. 9 is a perspective view of a modified, all-metal berm structure.
Figure 11:
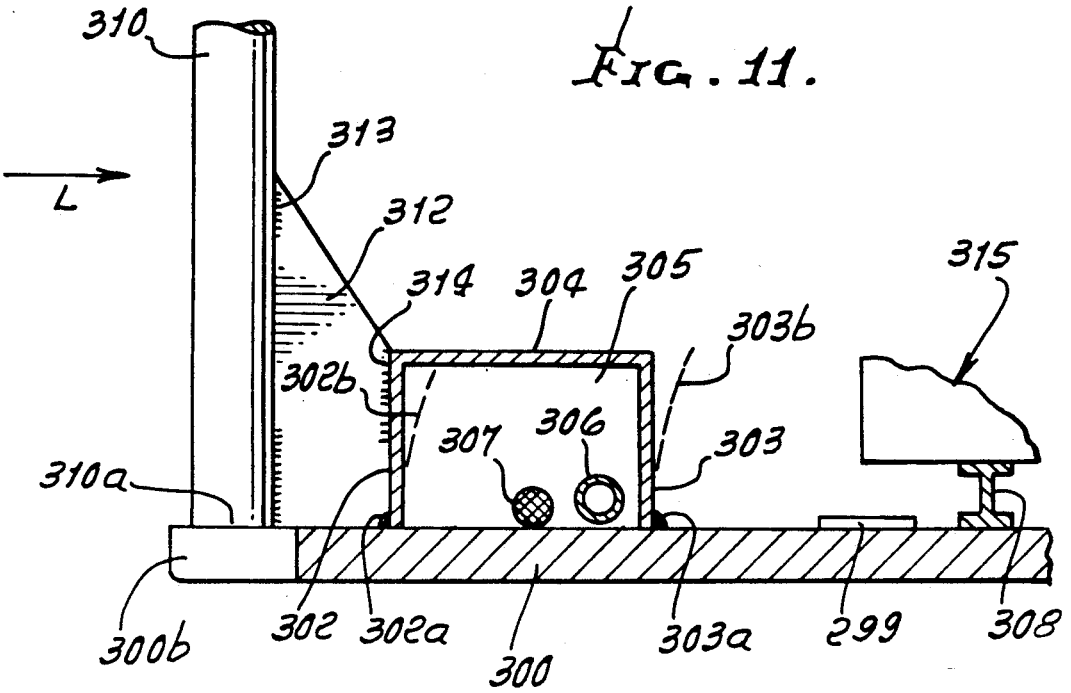
FIG. 11 is an enlarged section taken through a berm structure like that of FIG. 10 showing crash pole support.

FIG. 9 shows a transportable berm structure, including metallic plate structure, extending horizontally to support a tank assembly, as described, and to be described. See in this regard horizontal, rectangular plate 300, which may consist of steel. A metallic berm 301 is mounted on that plate, and extends in a rectangular loop, having berm side stretches 301a and 301b, and berm end stretches 301c and 301d. Each berm stretch may have a cross section, as indicated in FIG. 11, with spaced, parallel, upright plates 302 and 303 welded at 302a and 303a to plate 300, and a top plate 304 covering the enclosed space or tunnel 305. The latter may protectively receive or carry fluid piping 306, and/or electrical cabling 307, as may be included in a fire protection system for the tank assembly and its contents. A tank assembly 315 is typically supported on plate 300, inwardly of the berm, and on I-beam supports 308, as indicated. Note in FIG. 9 corner L-shaped brackets 309 of steel and extending upright to confine and center the tank.

Figure 10:
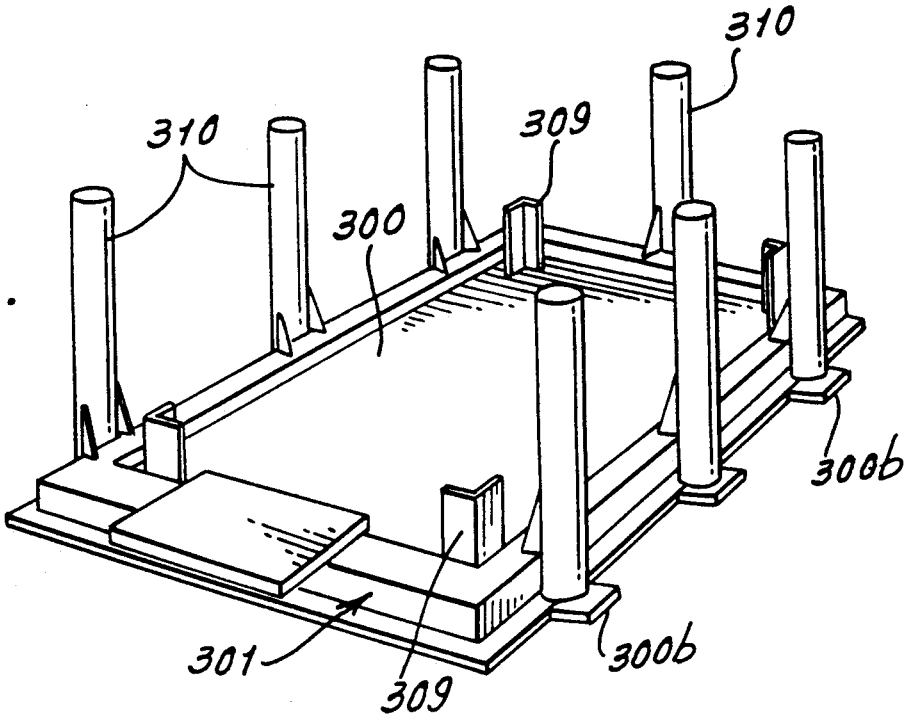
FIG. 10 is a perspective view of a further modified berm structure, with crash poles.

The construction shown in FIG. 10 is generally the same as in FIG. 9; however, upright steel crash poles 310 are added, and positioned outside the berm to receive and absorb crash loads (see arrow L in FIG. 11) as from exterior vehicles, thereby protecting the tank against impact.

FIG. 11 shows the pole 310 as supported at its lower end 310a on a plate extension 300b, as are all poles as seen in FIG. 10. A steel reinforcement strut 312 may be attached at one vertical edge to the pole (see weld connection 313) and may be attached at an opposite vertical edge to the berm 301 (see weld connection 314). The tank assembly is generally indicated at 315, spaced inwardly from, and protected by the berm and/or pole. The berm, as described, performs multiple functions, i.e., it contains tank drainage at 299 on plate 300; it protects and carries auxiliary equipment such as piping and cabling, as described; it laterally supports or reinforces the crash pole; and it acts with the pole to absorb lateral crash loads L, the wall 302 and 303 being able to laterally flex (see flexed positions 302b and 303b) in order to absorb side loading. Also, the entire unit or assembly is transportable from one point of tank installation to another, and separately from the tank, for performance of its multiple functions.

Figure 12:
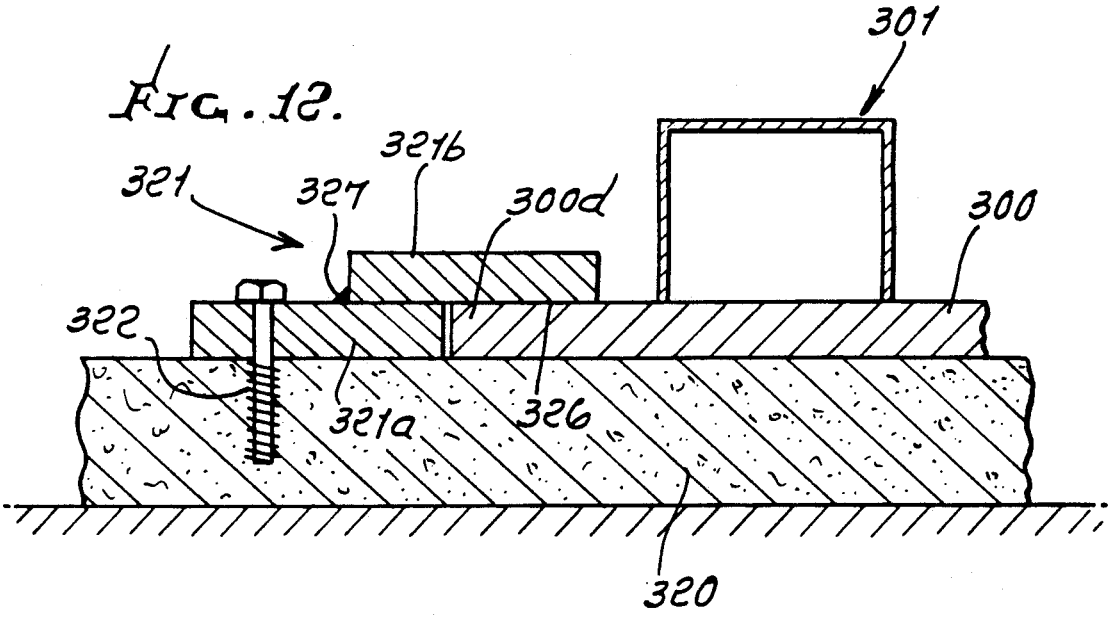
FIG. 12 is an enlarged section like FIG. 11 but showing berm bottom plate removable attachment to a foundation.

FIG. 12 shows a means to releasably attach the metallic plate 300 to a foundation, such as concrete or asphalt pad 320. As shown, auxiliary plate means 321 is attached, as by a fastener 322, to the pad, the plate means overlapping the portions 300d of the plate 300 protruding outwardly beyond the berm 301. Note that plate means 321 includes a lower plate 321a seating on the pad, and an upper plate 321b overlapping the main plate 300 at 326. Plates 321a and 321b are weld connected at 327.

Figure 13:
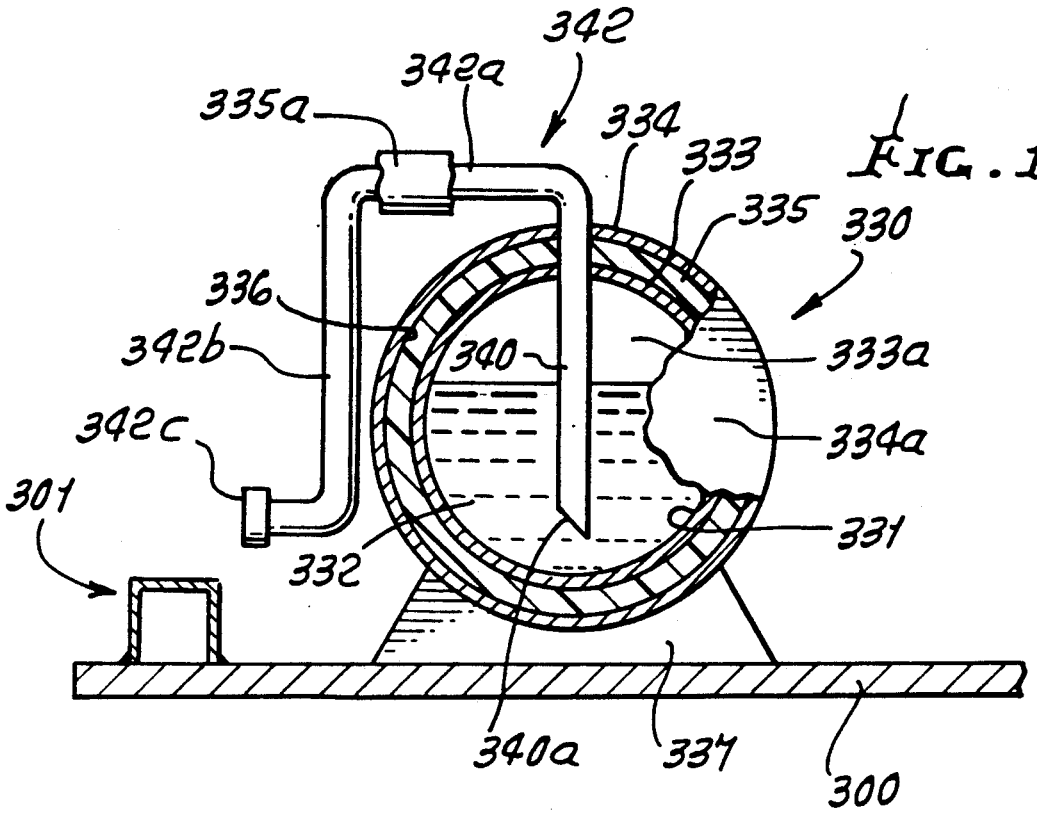
FIG. 13 is a vertical section taken through a modified double hull tank assembly, with external and internal ducting, the tank supported on a berm.

In FIG. 13, a fire-resistant tank assembly 330 has wall means defining an interior storage space 331 for flammable liquid 332. The wall means includes a first metallic, cylindrical wall 333 extending generally longitudinally; and a second metallic, cylindrical wall 334 also extending generally horizontally and concentrically about wall 333. Fire-resistant material 335 of one or more of the types referred to above substantially fills the space 336 between the two metal walls, that space typically being about two inches thick, but can be up to six inches thick. The outer tank is supported on the plate 300, as by supports 337. End walls 333a and 334a close opposite ends of the cylindrical walls 333 and 334; and spaces between walls 333a and 334a are also filled with fire-resistant material. See similar space in FIG. 1a for example, between tank end walls. Thus, inner and outer tanks are provided.

Means to fill liquid into the tank and/or dispense liquid from the tank interior 331 includes an interior duct 340 extending vertically within the interior to have a port 340a near the bottom of interior 331. Duct 340 extends up through the tops of the tanks, and connects to an exterior duct 342 having a horizontal stretch 342a, and a downcomer stretch 342b, with a fill or dispenser port 342c provided by a coupling. The exterior duct may be installed, and be covered with fire-resistant material 335a. The liquid in the FIG. 13 tank typically undergoes less than a 40° F. temperature increase in a 2,000° F. pool fire, over two hours.

Figure 14:
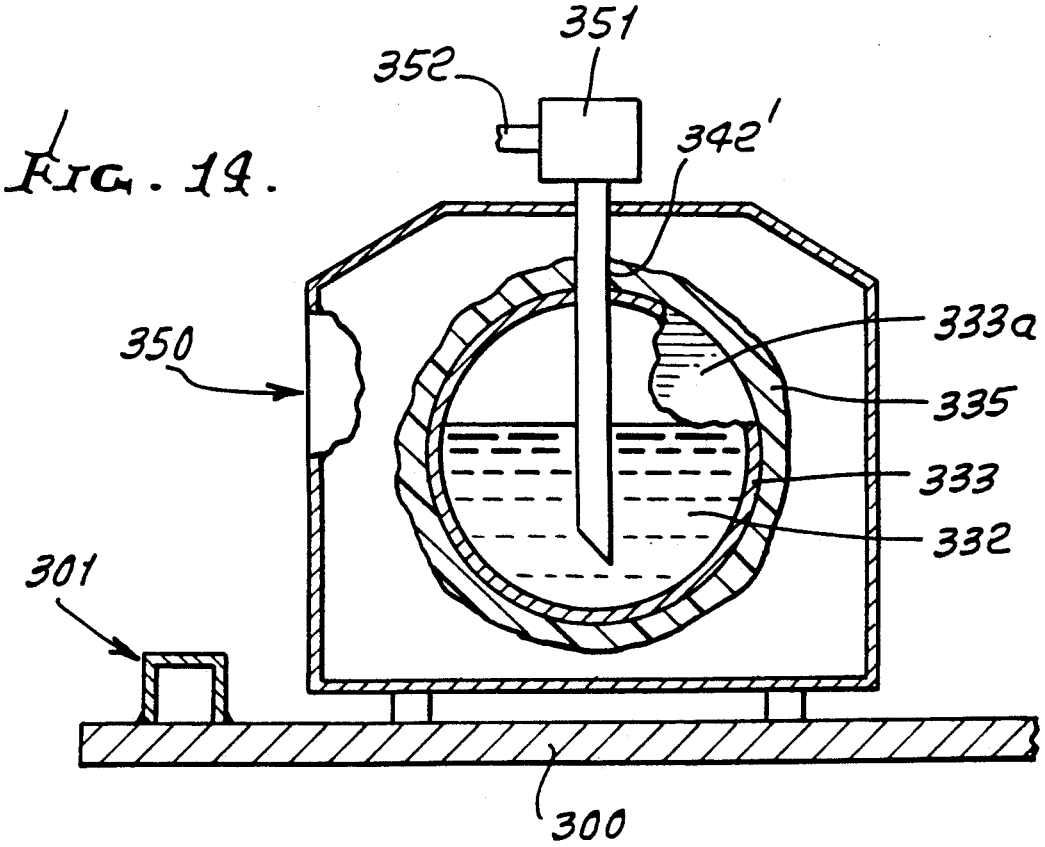
FIG. 14 is a view like FIG. 13 but showing a single, metal wall tank with outwardly exposed fireproofing material.
Figure 17:
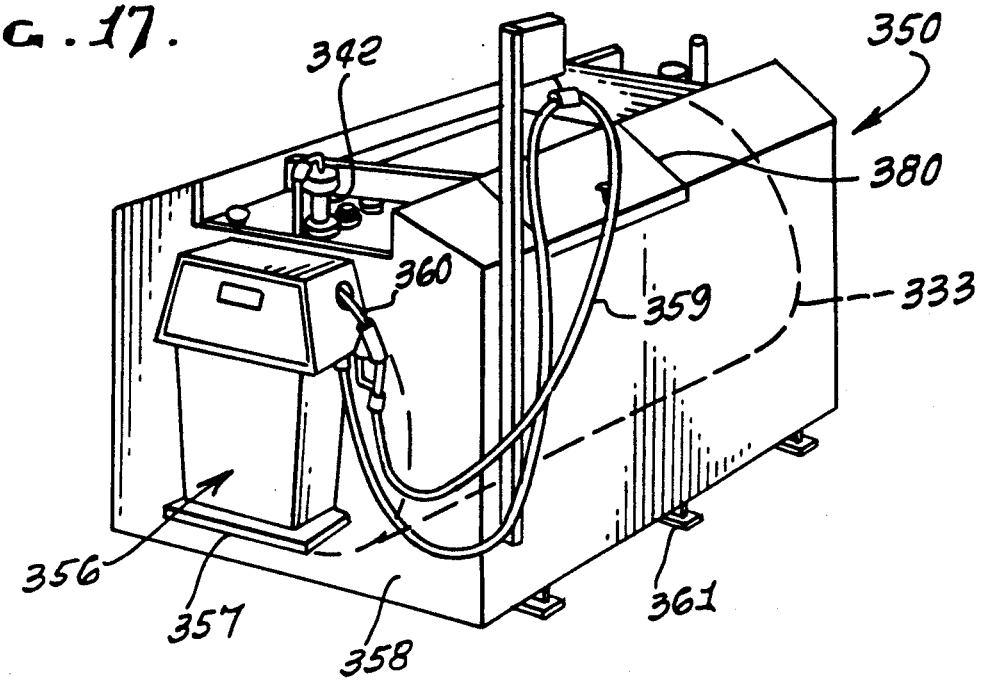
FIG. 17 is a perspective view showing an enclosed tank assembly with end dispenser, as in FIG. 15.
Figure 18:
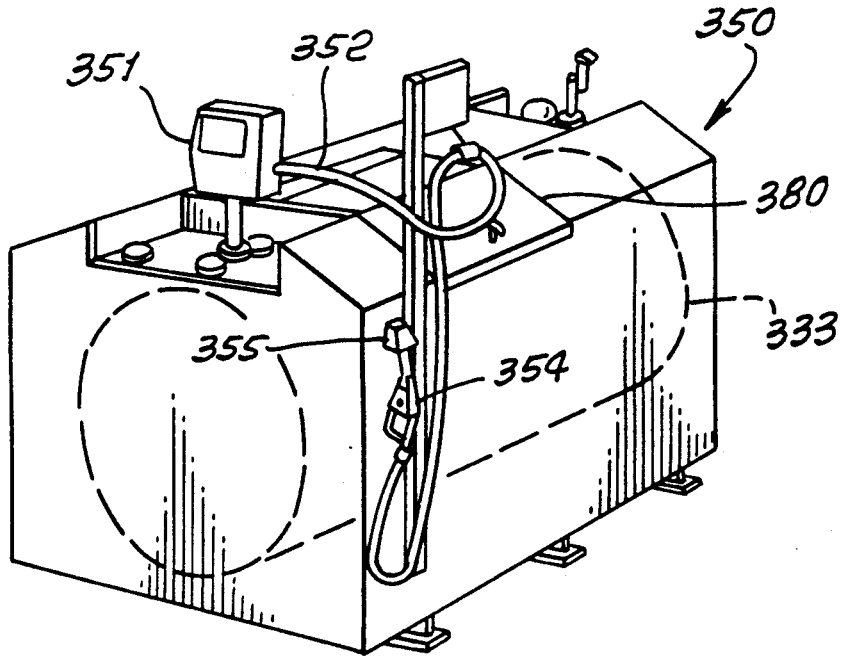
FIG. 18 is a view like FIG. 17 showing a similar enclosed tank assembly with top and side dispenser.

The tank construction seen in FIG. 14 is the same as that of FIG. 13 except that the outer metal tank wall 334 (and associated end walls) is omitted. The inner metallic wall 333, closed at its opposite ends, is entirely covered with fire-resistant material 335 (about two inches thick), as is the external duct structure 342. A metallic housing 350 surrounds the inner tank 333, as is also seen in FIGS. 17 and 18. See dispenser pump box 351 at the top of duct 342', externally of the tank 333 and housing 350, as in FIG. 18. Liquid in the FIG. 14 tank structure undergoes less than 100° F. temperature rise in two hours in a 2,000° F. pool fire.

In FIG. 18, a flexible dispensing line extends at 352 from the pump box 351 to a dispenser nozzle 354 supported on a hanger 355 on the housing side wall.

In FIG. 17, the external duct 342 is connected to a dispenser pump unit 356 supported on a shelf 357 at one end 358 of the housing. See also delivery line 359 and nozzle 360. Tank supports are seen at 361, and are sized to seat on the steel plate 300 referred to above.

Figure 15:
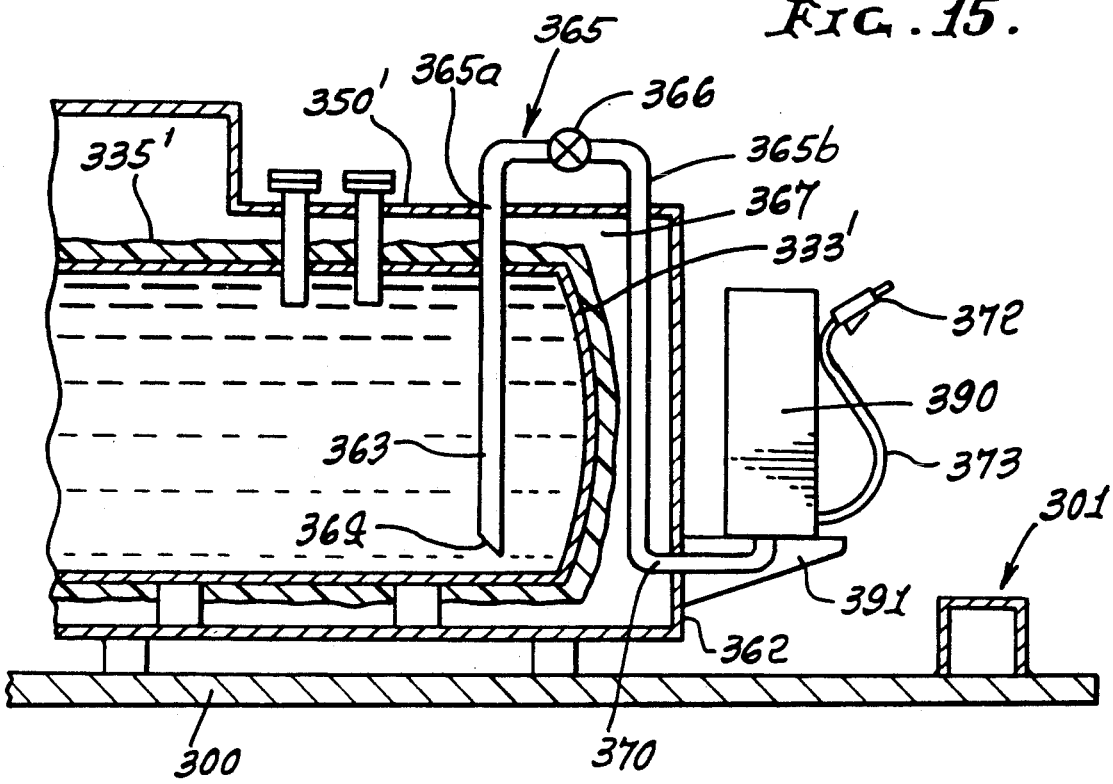
FIG. 15 is a vertical elevation, taken in endwise section, showing a tank assembly with dispenser at one end.

In FIG. 15, a single shell, cylindrical storage tank 333', is covered with fire-resistant material 335' (about two inches thick). An outer metallic housing 350', corresponding to that at 350 in FIG. 14, surrounds the storage tank. A pump dispenser 390 is supported on a shelf 391 at one end 362 of the outer housing. Internal dispenser/fill duct 363 extends vertically in the tank 333', and has a discharge/inlet port at 364 near the bottom of the tank interior. Duct 363 connects with an external duct 365 that protrudes at the exterior of the housing 350' at **365*a*. A control valve 366 is connected into duct length 365*a*. Duct 365 then extends downwardly at 365*b* in the space 367 between 333' and 350', at one end of the latter, as shown. Duct length 365*b* connects to a line 370 running beneath shelf 391 to the dispenser 390. A dispenser nozzle 372 connects to a delivery line 373** from the dispenser.

Figure 16:
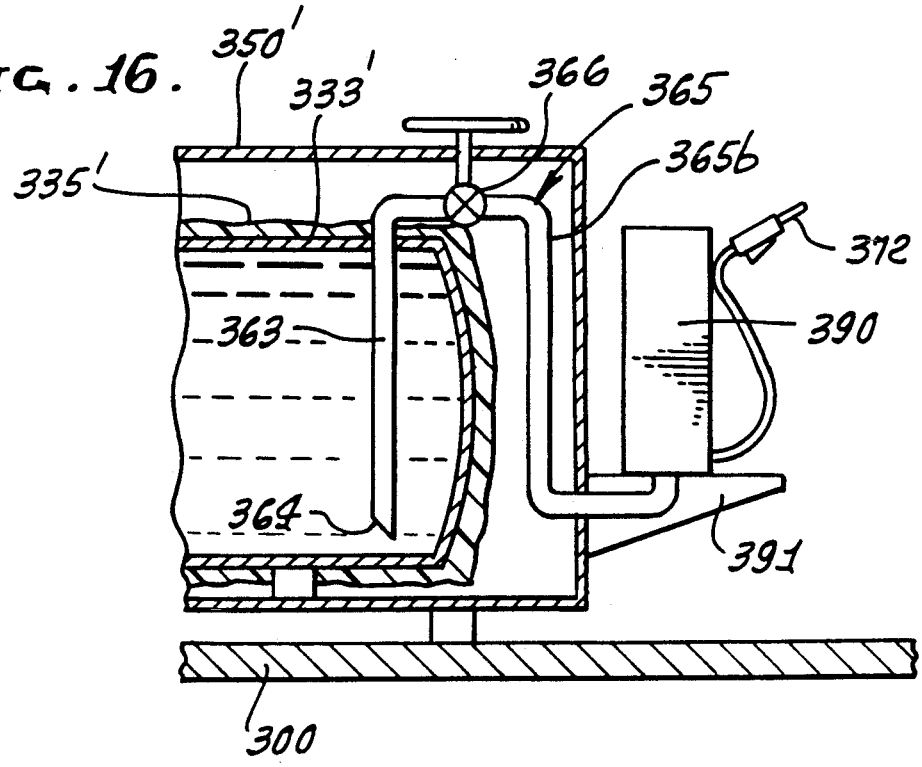
FIG. 16 is a view like FIG. 15 showing a modified dispensing system.

In FIG. 16, the structure is like that in FIG. 15 except that duct 365 is entirely within the space 367 between 333' and 350', that space filled with fire-resistant material.

Figure 19:
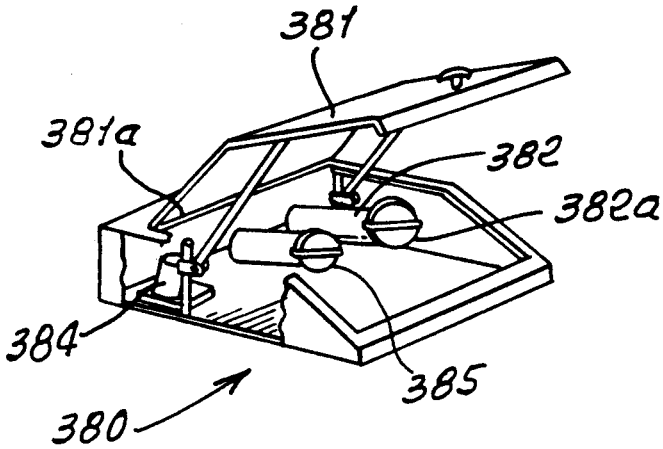
FIG. 19 is a perspective view showing a spill containment compartment.

In FIG. 19, a box or container 380 is shaped to fit into the top of the housing 350, as is indicated in FIGS. 17 and 18. That box has a lid 381, hinged at **381*a* to be elevated, giving access to the box interior. A flammable liquid fill port 382 is provided in the box interior and is capped at 382*a*. Spillage is contained in the box and drains to the tank 333 interior, via a drain at 384. A sight gauge is also provided at 385**.

FIG. **2*a* is a schematic showing of a multiple tank assembly, with multiple ports as labeled, the assembly being similar to the FIG. 1*a*** assembly.

I claim:

1. In fire resistant tank apparatus adapted for transportation and for installation above-ground to receive and dispense a liquid hydrocarbon, the combination comprising a) a tank assembly having lightweight wall means defining inner wall means, and outer wall means, there being primary space between the inner wall means, and the outer wall means, b) first means on the assembly defining access porting to a tank interior defined by the assembly, c) a bottom wall defined by the assembly adapted to support the assembly at an installation site, d) thermal barrier material located in said primary space to effectively define a shell about said tank interior, e) and structure adjacent said wall means to support a dispenser for said liquid hydrocarbon, f) said structure defining a drain to drain leaking liquid hydrocarbon to a receptacle below the level of said structure, and including said receptacle which comprises a concrete slab supporting said tank assembly at elevated position above the slab.

2. The combination of claim 1 wherein said thermal barrier material substantially fills said primary space.

3. The combination of claim 1 wherein said space containing said thermal barrier material effectively encloses said tank interior at the top, bottom and sides thereof.

4. The combination of claim 2 wherein said thermal barrier material is selected from the group that consists of VERMICULITE, foamed concrete, FENDOLITE, styrofoam, pumice, and mixtures thereof.

5. The combination of claim 4 wherein said thermal barrier material also includes a thin layer of a mixture of Portland cement and VERMICULITE adjacent said inner wall means.

6. The combination of claim 1 wherein said inner wall means defines a cylindrical inner tank forming said tank interior, the outer wall means and inner tank being above ground.

7. The combination of claim 6 wherein said outer wall means defines an outer tank extending about the inner tank.

8. The combination of claim 1 including fire resistant material applied to said assembly at the outer side thereof.

9. The combination of claim 8 wherein said fire resistant material is applied to the outer wall means, and has thickness between about ¼ inch and 1 inch.

10. In fire resistant tank apparatus adapted for transportation and for installation above-ground to receive and dispense a liquid hydrocarbon, the combination comprising a) a tank assembly having lightweight wall means defining inner wall means, and outer wall means, there being primary space between the inner wall means, and the outer wall means, b) first means on the assembly defining access porting to a tank interior defined by the assembly, c) a bottom wall defined by the assembly adapted to support the assembly at an installation site, d) thermal barrier material associated with said wall means to effectively define a shell about said tank interior, e) and structure adjacent said wall means to support a dispenser for said liquid hydrocarbon, said structure including a platform unit projecting sidewardly adjacent a lower portion of said outer wall means, for supporting said dispenser in adjacent relation to the side of said outer wall means, f) and wherein said structure defines a drain to drain leaking liquid hydrocarbon to a receptacle below the level of said structure, and including said receptacle which comprises a concrete slab supporting said tank assembly at elevated position above the slab.

11. The combination of claim 10 wherein said platform unit is attached to the side of the outer wall means, and includes a top plate supporting said dispenser, and a lower drain plate inclined toward said receptacle, there being a drain opening in the top plate and above the lower plate.

12. The combination of claim 10 including said dispenser which includes a pump unit supported on said platform, and a dispensing hose and nozzle associated with said pump unit.

13. The combination of claim 12 wherein said receptacle includes a berm about the slab, and below the level of said drain.

14. The combination of claim 10 including means associated with the receptacle to dispense a fire extinguishing gas upwardly and about the tank assembly.

15. The combination of claim 10 including a metallic plate structure beneath the tank assembly and supporting said assembly, and a berm extending in a loop, on said plate structure to retain liquid draining from said assembly on said plate structure.

16. In fire resistant tank apparatus adapted for transportation and for installation above-ground to receive and dispense a liquid hydrocarbon, the combination comprising a) a tank assembly having lightweight wall means defining inner wall means, and outer wall means, there being primary space between the inner wall means, and the outer wall means, b) first means on the assembly defining access porting to a tank interior defined by the assembly, c) a bottom wall defined by the assembly adapted to support the assembly at an installation site, d) thermal barrier material associated with said wall means to effectively define a shell about said tank interior, e) and structure adjacent said wall means to support a dispenser for said liquid hydrocarbon, said structure including a platform unit projecting sidewardly adjacent a lower portion of said outer wall means, for supporting said dispenser in adjacent relation to the side of said outer wall means, f) and including a metallic plate structure beneath the tank assembly and supporting said assembly, and a berm extending in a loop, on said plate structure to retain liquid draining from said assembly on said plate structure, g) and including crash poles associated with said plate structure and extending upright, at location about said tank assembly.

* * * * *